United States Patent [19]

Hemphill

[11] Patent Number: 4,476,642

[45] Date of Patent: Oct. 16, 1984

[54] DIGGING TOOTH AND HOLDER ASSEMBLY

[75] Inventor: Charles W. Hemphill, Duncanville, Tex.

[73] Assignee: Hemphill Industries, Inc., Mansfield, Tex.

[21] Appl. No.: 445,396

[22] Filed: Nov. 30, 1982

[51] Int. Cl.[3] ..... E02F 9/28

[52] U.S. Cl. ..... 37/142 R; 29/525; 37/191 A; 279/102; 299/91; 403/332

[58] Field of Search ..... 37/141 R, 141 T, 142 R, 37/142 A, 191 A, 192 A; 403/332; 175/409–411, 379, 327, 413, 415; 299/91–93, 79; 29/525; 279/97, 102; 30/316, 342, 113.1; 145/61 R, 24–26

[56] References Cited

U.S. PATENT DOCUMENTS

| | | | |
|---|---|---|---|
| 1,318,958 | 10/1919 | Bernay | 175/413 X |
| 1,551,815 | 9/1925 | Ferguson | 30/113.1 |
| 2,010,590 | 8/1935 | Grumbacher | 145/24 X |
| 3,610,691 | 10/1971 | Penote et al. | 37/142 R X |
| 3,888,028 | 6/1975 | White | 37/142 R |
| 3,888,637 | 6/1975 | Taguchi et al. | 37/142 R X |
| 4,098,013 | 7/1978 | Hemphill | 37/142 R |

FOREIGN PATENT DOCUMENTS

| | | | |
|---|---|---|---|
| 347536 | 4/1931 | United Kingdom | 30/342 |

*Primary Examiner*—Clifford D. Crowder
*Attorney, Agent, or Firm*—Marcus L. Bates

[57] ABSTRACT

A digging tooth is removably received within a tooth receiving holder. The holder is attached to a digging apparatus, such as a trencher machine, for example. The holder includes a socket within which a shank of the tooth is removably received. The socket of the holder is in the form of an outwardly opening, elongated cavity which rearwardly tapers so that the cavity is progressively reduced in size. The tooth shank is rearwardly tapered and made complementary respective to the socket cavity, so that when the shank is telescopingly forced into the cavity, it is wedgedly held in assembled relationship and is easily removed therefrom, and the teeth therefore can subsequently be rapidly and easily replaced.

22 Claims, 28 Drawing Figures

DIGGING TOOTH AND HOLDER ASSEMBLY

BACKGROUND OF THE INVENTION

Modern excavating apparatus, such as the trencher and backhoe, are highly efficient in digging trenches and ditches. These apparatus require digging teeth of various different configurations made to initially engage the earth and remove increments therefrom as the teeth are forced to move in a particular manner. In a trencher, for example, a new set of teeth of proper design and construction will often enable several hundred feet of trench to be formed during the first few hours of operation. However, depending upon the characteristics of the removed earth, the teeth may rapidly wear and become dull, and often the efficiency of operation is reduced by fifty percent or so by the end of the second working day. It is not uncommon for the production rate of the excavated trench to be reduced to one-third of the production rate achieved during the first few hours of operation.

Therefore, on a trencher of the type having an endless chain to which there is attached a plurality of digging teeth, it is not uncommon to replace the teeth after only three days of operation, otherwise the digging apparatus is operating at only one-third efficiency. There may be 40 digging teeth on the trencher apparatus, and in order to replace the digging teeth, it may be necessary for two men to work for more than one-half day. Most prior art teeth usually are fabricated from a bent up piece of heat treated metal, having apertures formed therein by which each digging tooth is attached to the endless chain in spaced relationship respective to one another. The chain usually supports the digging teeth on alternate sides thereof, so that there must be right hand and left hand digging teeth spaced along the chain. Under conditions such as this, the expense involved in replacing the teeth is considerable because the entire tooth assembly must be removed and a new tooth substituted therefor. This action represents a considerable expense, as well as substantial loss in excavating time along with the cost of the labor required for replacing the teeth.

Accordingly, it would be desirable to have made available a new digging tooth assembly having a holder device rigidly attached to the digging apparatus which need not be replaced each time a tooth becomes worn. The holder device preferably removably receives a digging tooth therein which can be rapidly mounted to the holder device. Moreover, it would be desirable if the tooth and holder assembly was fabricated in a manner to enjoy a longer digging life as compared to most other prior art teeth. A digging tooth and holder assembly of this type is the subject of the present invention.

SUMMARY OF THE INVENTION

A digging tooth and holder assembly for use in a digging apparatus, such as a trencher. The holder is affixed to the digging apparatus and includes a socket within which a shank of the tooth is removably received. The socket of the holder is in the form of an outwardly opening, elongated cavity which rearwardly tapers so that the cavity is progressively reduced in size.

The tooth shank rearwardly extends from a digging end thereof and is rearwardly tapered complementary respective to the socket cavity so that the shank is telescopingly received in a removable manner within the cavity of the holder, and is wedgedly held in assembled relationship therewith. The shank and cavity are of a semi-toroidal configuration when viewed in lateral cross-section.

In one form of the invention, the holder includes a vertical web member for being bolted in spaced relationship onto the endless chain of a trencher machine. In another form of the invention, the holder includes a rearwardly extending yoke or tang which is rigidly affixed to the lip of the leading edge of a digging bucket.

In another embodiment of the invention, the digging end of the tooth is in the form of a toroid which circumferentially extends almost 180°, and includes a curved forwardmost digging edge. The outer surface or sidewall of the digging member is aligned at a low angle respective to the longitudinal sidewall of the ditch, and the inside circumferentially extending sidewall of the digging tooth slopes inwardly in a manner similar to one-half of a cone. The surface of the cone is hardened.

Accordingly, the outer cylindrical surface of the digging end of the tooth wears at a greater rate respective to the inner conical surface and therefore, the leading edge of the tooth maintains a sharp ground engaging surface, due to the differences in the relative wear rates of the two converging surfaces.

The shank of the digging tooth and the cavity of the holder has great strength due to the elongated, outwardly opening cavity extending into the holder, with the cavity being curved about a longitudinal axis spaced therefrom. The holder includes spaced interior wall surfaces which converge towards one another to provide the wedge like cavity. The shank, being made complementary respective to the cavity, wedgedly engages the cavity in a removable manner therewith.

The digging tooth shank can therefore be wedgedly forced into the cavity, and when it is time to change digging teeth, the digging tooth can be easily forced from the cavity and replaced with a new digging tooth, in a rapid and unusual manner.

Accordingly, a primary object of the present invention is the provision of a digging tooth and holder assembly therefor for use in conjunction with a digging apparatus, wherein the digging tooth can be rapidly removed from and assembled respective to the holder.

Another object of the invention is to provide method and apparatus by which a digging tooth and holder assembly can be fabricated and incorporated into a digging apparatus so that the digging tooth can easily be removed and replaced respective to the holder.

A further object of this invention is to disclose and provide a method of fabricating a holder device for receiving a digging tooth therewithin.

A still further object of this invention is to provide a method and apparatus for digging a trench with an improved digging tooth. C W. HEMPHILL Another and still further object of the present invention is the provision of a digging tooth and holder assembly, wherein the holder has an elongated outwardly opening cavity extending thereinto, which is curved about an axis spaced therefrom, and includes spaced wall surfaces which converge towards one another to provide a wedge-like cavity, and the tooth has a shank made complementary respective to the cavity and is wedgedly received in a removable manner therewithin.

An additional object of the present invention is the provision of a digging tooth having an annular cutting edge formed thereon which includes a conical inner surface and a cylindrical outer surface, so that the outer cylindrical surface wears at a greater rate respective to the inner conical surface, thereby maintaining the cutting edge of the digging tooth in sharp configuration.

A still further object of this invention is to provide a digging tooth and a holder therefor which enables the digging tooth to be removably mounted respective to the holder, and wherein the holder is affixed to a digging apparatus.

Another and still further object of this invention is the provision of a digging tooth and holder assembly wherein the digging tooth has a shank which is of toroidal configuration in cross-sectional area, and which is wedgedly received within a complementary configurated cavity of the holder; so that, the tooth shank and holder have great strength due to the geometrical configuration thereof.

An additional object of the present invention is the provision of a digging tooth and holder assembly for use in combination with the forward lip of an excavating bucket.

Another object of the invention is to provide a digging tooth and holder assembly for use in conjunction with a trenching machine having an endless chain, wherein the holder is attached to the endless chain, and the digging tooth is removably affixed thereto.

These and various other objects and advantages of the invention will become readily apparent to those skilled in the art upon reading the following detailed description and claims and by referring to the accompanying drawings.

The above objects are attained in accordance with the present invention by the provision of a method for use with apparatus fabricated in a manner substantially as described in the above abstract and summary.

DETAILED DESCRIPTION OF THE PREFERRED EMBODIMENTS

Figure 1:
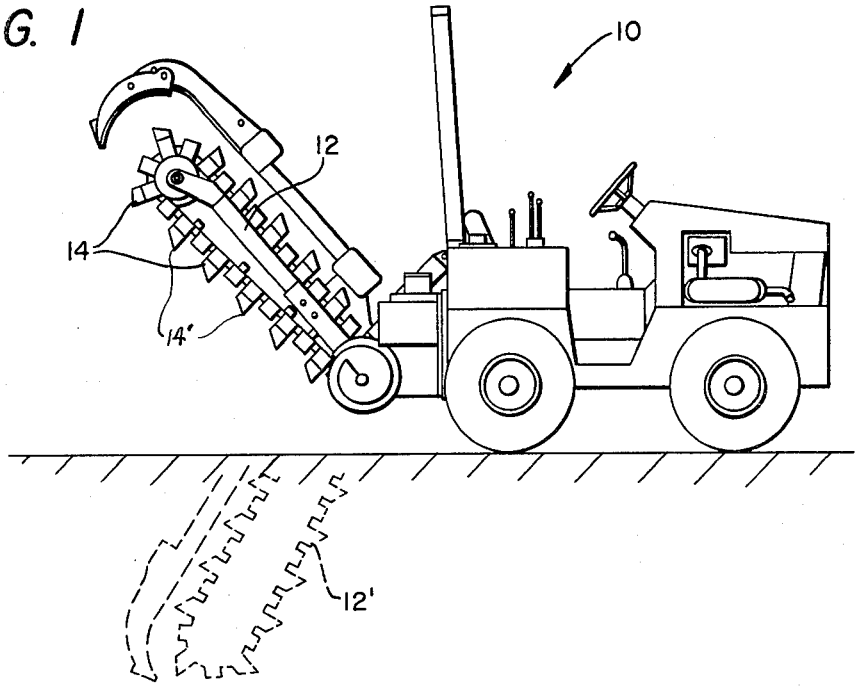
FIG. 1 is a side elevational view of a prior art trenching machine having teeth mounted thereto made in accordance with the present invention.

FIG. 1 of the drawings discloses a prior art trenching machine 10, such as for example, a Ditch Witch Trencher, (TM) known to those skilled in the art. The trencher includes an endless chain disposed between suitable sprocket means so that rotation thereof causes the illustrated upper and lower flights of the chain to move along the length thereof. A multiplicity of digging teeth assemblies are attached on alternate sides of the upper and lower runs of the chain, with there being left hand teeth 14 and right hand teeth 14' alternately arranged in spaced relationship along the entire length of the chain. The teeth which are mounted to the lower run of the endless chain engages and excavates earth in order to form a trench in a manner broadly known to those skilled in the art.

Figure 2:
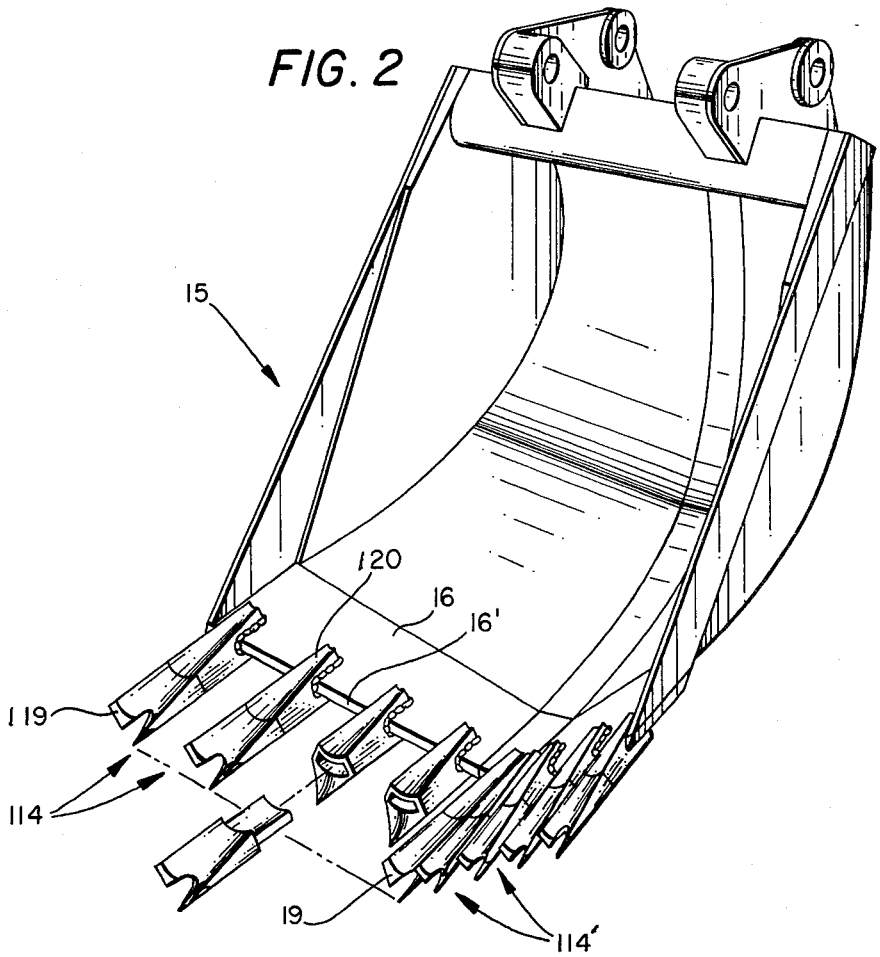
FIG. 2 is a perspective view of a prior art excavating bucket having digging teeth at the leading edge thereof made in accordance with the present invention.

FIG. 2 discloses a prior art digging bucket 15, such as disclosed in U.S. Pat. Nos. 4,037,337 and 4,133,121, for example. The bucket includes a lip 16 which terminates at the forward end 16' thereof, to which there is attached a plurality of digging teeth assemblies 114 made in accordance with the present invention. Each of the assemblies 114 includes a removable digging tooth 119 which is received within a tooth holder 120. The holder is affixed to the bucket lip 16.

In FIGS. 3–16 there is disclosed the before mentioned digging tooth and holder assembly 14, which includes a digging tooth 19 removably received within a holder assembly 20. As particularly seen in FIG. 3, together with other figures of the drawings, each of the assemblies 14 include a tooth 19. The tooth 19 has a curved cutter head 21 located at the digging end thereof, and a shank 22 integrally attached thereto and depending away therefrom. The shank 22, as seen in FIGS. 7 and 11–16, is attached at 23 to the cutter device, and includes a free terminal end 23. The shank is in the form of a curved annulus, or an incomplete toroid, and includes an inner cylindrical surface 25. An outer cylindrical surface 26 converges towards the inner cylindrical surface in a direction towards the terminal end 24 thereof. The circumferential length of the cylindrical or toroidal shank is defined by an upper longitudinally extending end wall 27 and a lower longitudinally extending end wall 28. The end walls lie within a common plane and converge towards one another in a direction away from the digging or ground engaging end 21 of the tooth.

Figure 3:
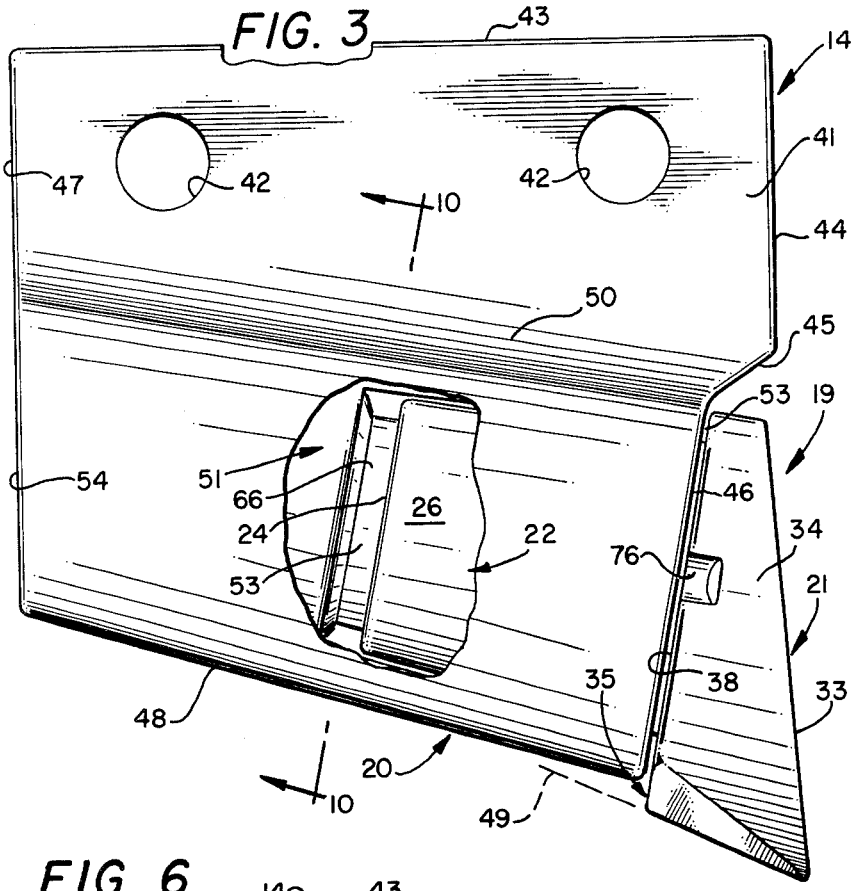
FIG. 3 is an enlarged, side elevational view of a digging tooth and holder assembly made in accordance with the present invention which is used in conjunction with the trenching machine of FIG. 1.
Figure 4:
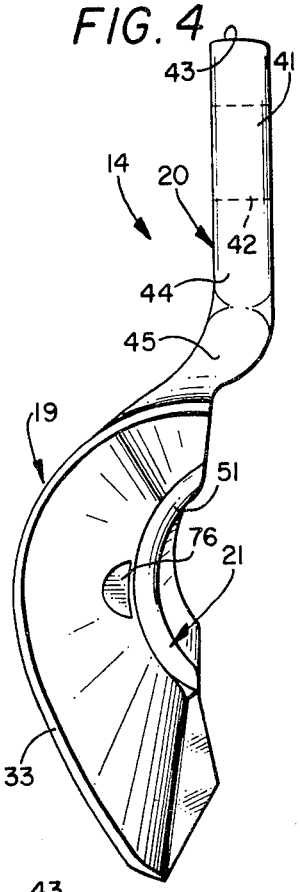
FIG. 4 is a front end view of the digging tooth and holder assembly of FIG. 3.
Figure 13:
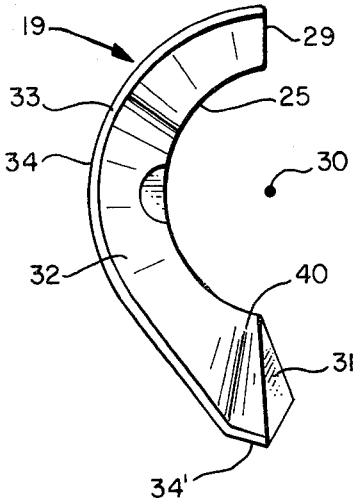
FIG. 13 is an end view of part of the apparatus seen illustrated in FIG. 12.

As seen in FIGS. 3, 4 and 13, the cutter head 21 is in the form of a complex annular body member which commences at an upper end wall 29 and curves about a longitudinal axis 30 and terminates at a lower end wall 31. The lower end wall 31 lies in a plane which intersects the longitudinal axis 30 at a point forwardly of an oblique, truncated, discontinuous, conical wall surface of the cutter head.

Figure 14:
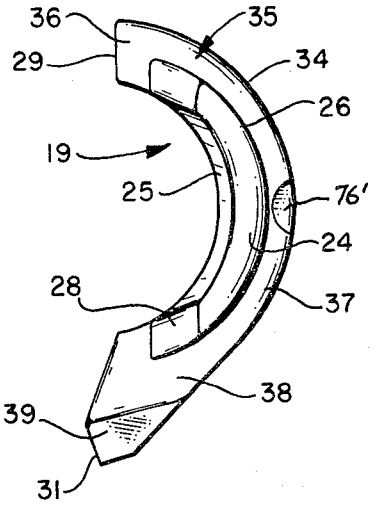
FIG. 14 is a front elevational view of the digging tooth disclosed in FIG. 13, and showing the opposite end thereof.
Figure 15:
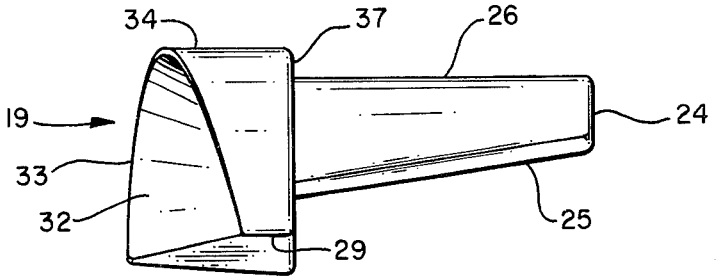
FIG. 15 is a top plan view of the apparatus illustrated in FIG. 14.
Figure 16:
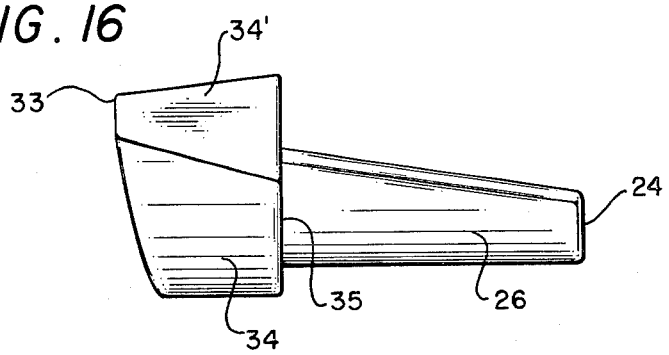
FIG. 16 is a bottom view of the apparatus disclosed in the foregoing FIGS. 13–15.

The cutter head is provided with a curved cutting edge 33 formed at the junction between the conical inner surface 32 thereof and an outer curved wall surface 34. The wall surface 34 is an incomplete, oblated, ellipsoid. In FIG. 14, the rear face 35 of the cutter head, which joins to the shank, forms an outer flange area which extends from area 36 adjacent to the upper end wall 29, continues about the shank at 37, and includes a lower area 38, where the flange area then is turned forwardly at surface 39 to form a slight angle between the surfaces 39 and 38.

As seen in FIG. 13, the lower end wall 31 is joined to the conical surface 40 and forms an obtuse angle therebetween, and then continues as the conical surface 32. The inner cylindrical surface 25 of the shank extends forwardly in the illustrated manner of FIGS. 11, 12, 13 and 14 until the surface outwardly diverges into the before mentioned cone 32.

Figure 6:
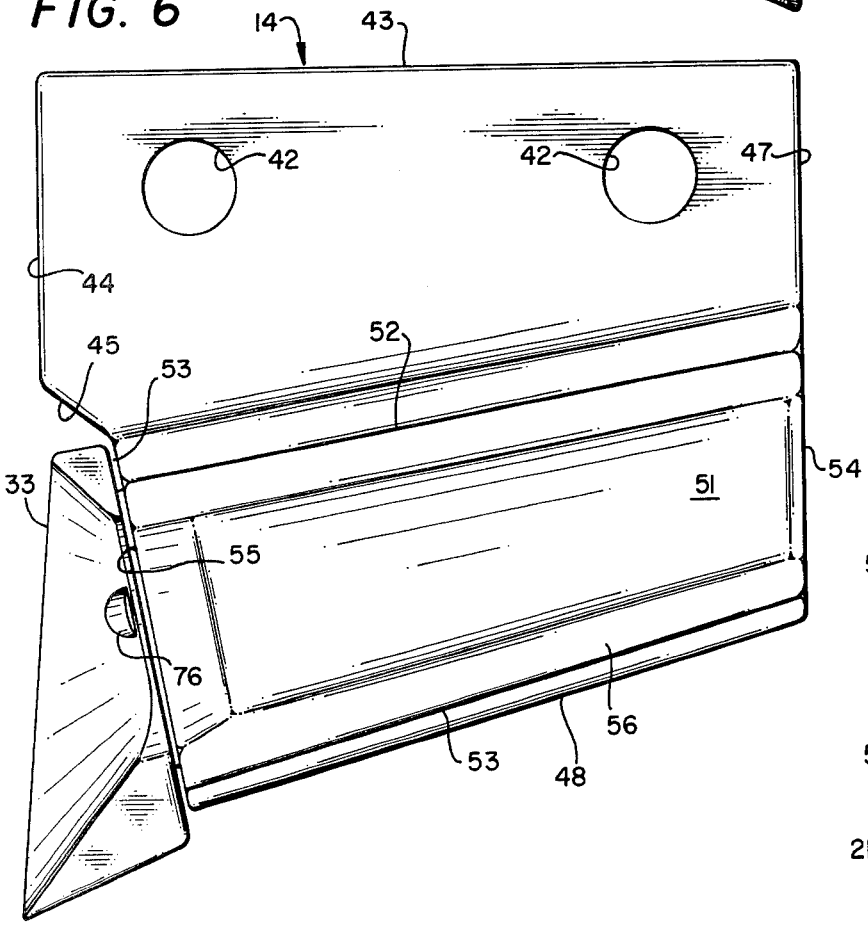
FIG. 6 is an assembled side elevational view illustrating the opposite side of the assembly seen illustrated in FIG. 3.
Figure 7:
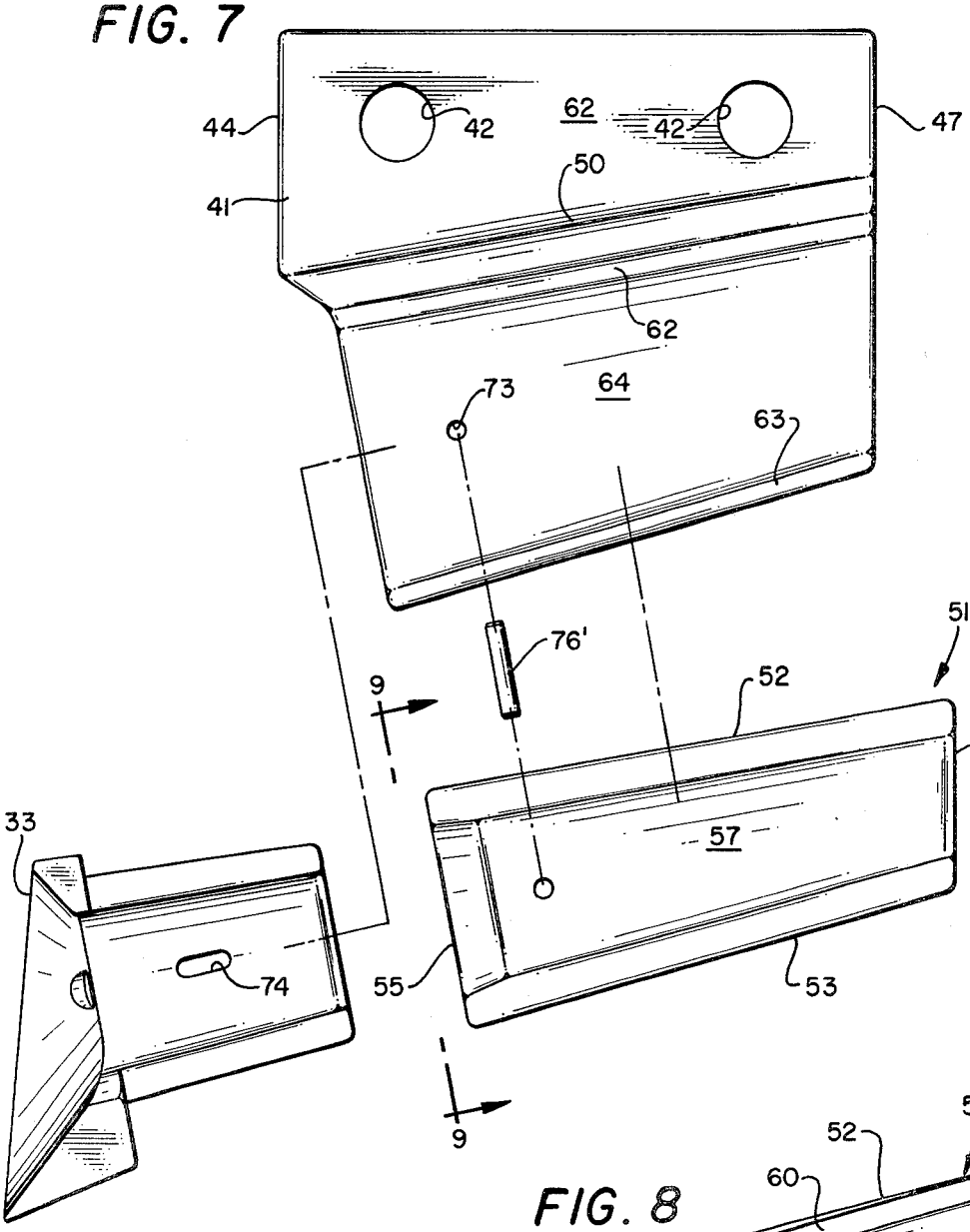
FIG. 7 is an exploded side elevational view of the digging tooth and holder assembly seen illustrated in FIGS. 3–6.

In FIGS. 3–7, the holder 14 is shown in conjunction with the digging tooth. In FIGS. 3 and 7, the flange 41 includes an upper edge portion 43, a front edge 44 which curves rearwardly at 45, and then proceeds in a lateral curve, and is then joined at edge portion 46. A rear edge portion 47 extends downwardly from upper edge 43, and then likewise curves laterally in a manner similar to the front edge, and then curves to meet lower edge 48. The diameter of the curve at edge 46 is greater than the diameter formed at edge 54. Numeral 50 broadly indicates the transition area between the lower curved portion of the holder and the flat portion 41 thereof.

Figure 5:
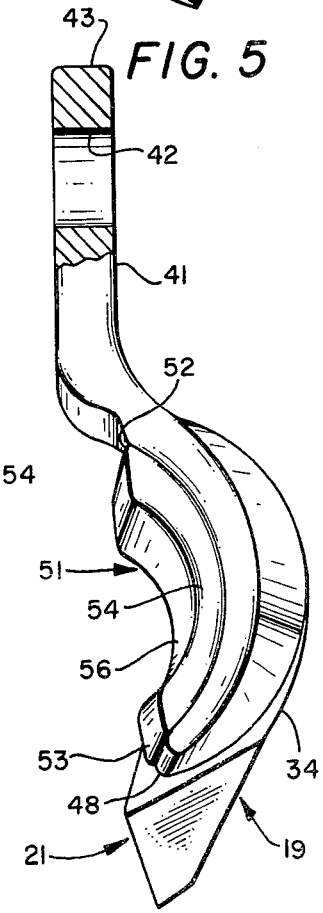
FIG. 5 is a rear end view of the apparatus disclosed in FIG. 4.
Figure 8:
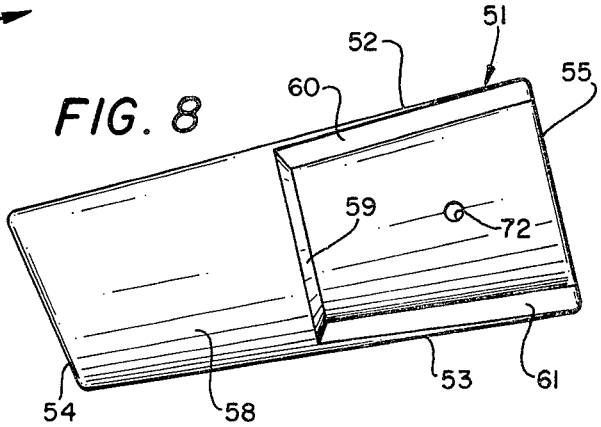
FIG. 8 is an opposite side elevational view of part of the apparatus disclosed in FIG. 7.
Figure 9:
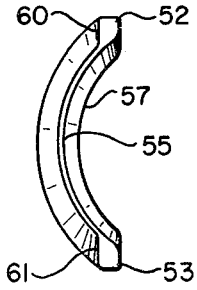
FIG. 9 is a front end view of the device illustrated in FIG. 8.

As best seen in FIG. 5, an inner cylindrical member 51, the details of which are more specifically set forth in FIGS. 7 and 8, is rigidly attached to and forms an integral part of the holder. The inner cylindrical member 51 includes an upper edge portion 52 spaced from a lower edge portion 53. The edge portions 52 and 53 converge towards one another in a direction towards the rear edge 54 thereof. Front edge 55 of the inner cylindrical member 51 is spaced from and is disposed more or less parallel to the front edge 46 of the main body of the holder. Numeral 56 of FIG. 5 indicates the curved outer wall surface of the inner cylindrical member 51.

Figure 12:
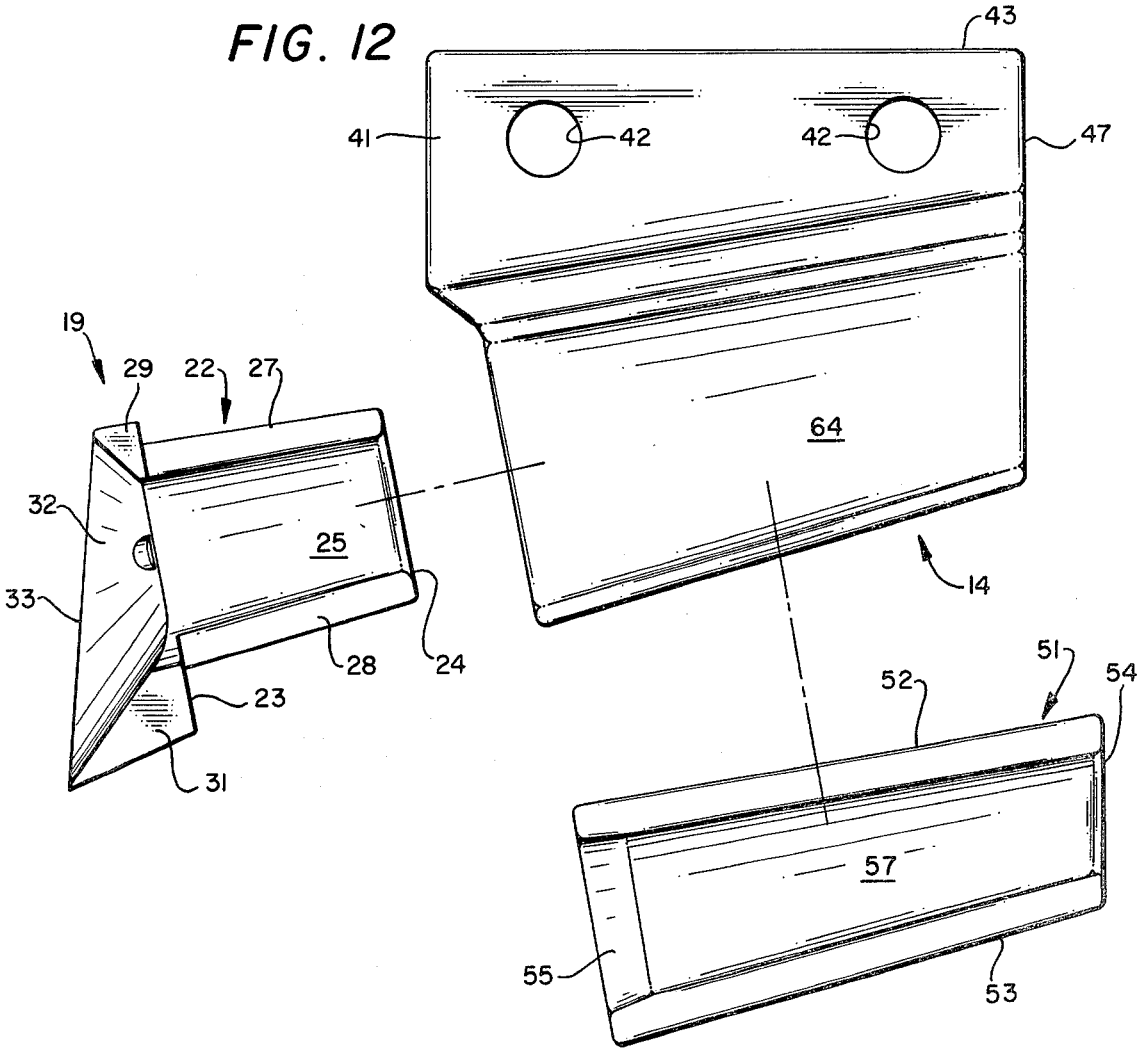
FIG. 12 is an exploded, side elevational view of the digging tooth and holder assembly of FIG. 11.

FIGS. 6, 7, 8 and 12 illustrate the opposite side of the inner cylindrical member 51. In FIG. 7, member 51 includes a cylindrical or curved central portion 57 which extends longitudinally from edge portion 55 to end portion 54, and, as seen in FIG. 8, includes an inner end wall 59 formed by the thicker curved portion at marginal end 58. Relatively flat, longitudinally extending, opposed surfaces 60 and 61, form a surface against which the edge portions 27, 28 of the shank of FIG. 12 is engaged.

Figure 10:
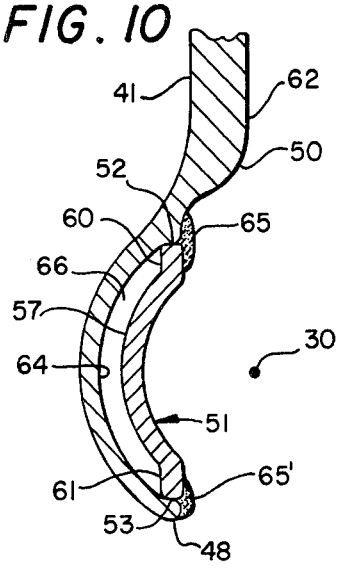
FIG. 10 is a cross-sectional view taken along line 10—10 of FIG. 3.
Figure 11:
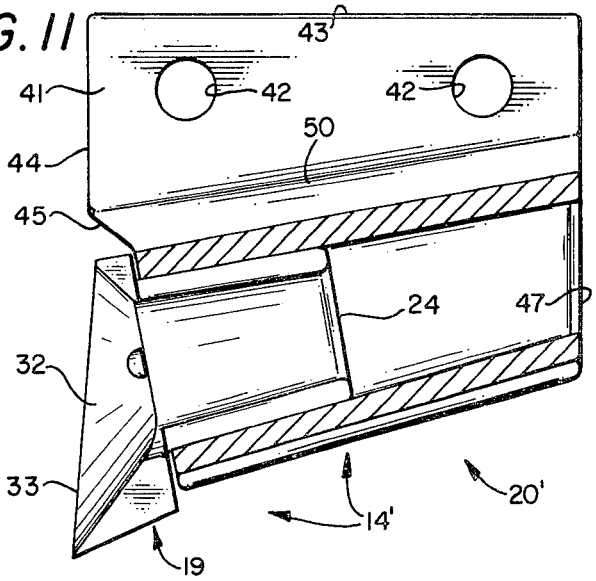
FIG. 11 is a part cross-sectional, longitudinal view of the assembly illustrated in FIG. 6.

FIGS. 3 and 7 disclose opposed sides of the holder member 14. In FIG. 7, the inner cylindrical member 51 has been removed therefrom. The opposed surface 62 of the main body of the holder member curves in a downward direction at 50, and then curves more or less parallel to surface 52, thereby forming a longitudinally extending step 62. Step 62 engages edge portion 60 of the cylindrical member 51 (FIG. 8). Longitudinally extending, lower free edge portion 63 lies in the same plane as step 62. Edge portions 62 and 63 converge towards one another in a rearward direction and intersect at a point (not shown) spaced from the holder. Inner cylindrical surface 64 forms one of the interior sidewalls of the shank pocket 66 (FIG. 10). The shank pocket, or cavity 66, is outwardly opening and extends from rear wall 59 (FIG. 8) to the opening at 46 (FIG. 3), with the opening being formed by edges 55 and 46 of FIGS. 3 and 6. The inner cylindrical member 51 is shown removed from the main body of the mount member in FIGS. 7, 8, and 12.

Member 51 is joined to the main body of the mount member by placing member 51 in the illustrated relative position seen illustrated in FIGS. 3 and 6. The longitudinally extending edge portions 52, 53 (FIG. 10) are welded to the main body by making one or more welding passes 65, 65', thereby integrally joining member 51 to the main body of the holder. Cavity 66 is preferably of constant cross-sectional thickness from end wall 60 to end wall 61 when viewed in cross-section as seen in FIG. 10. The cavity is in the form of an annular body which curves about a longitudinal axis 30 and describes an incomplete toroid having surfaces which are a frustum of a cone. The cavity converges rearwardly and is made complementary respective to the tooth shank.

The method of building the digging tooth assembly of the present invention is carried out by making a right and left hand digging tooth 19 and corresponding holder 20 by casting or forging. It is preferred to forge each of the teeth by using a forging die and employing conventional methods of construction. The inside surface 32 of the cutter head is provided with hard surfacing, for example, tungsten carbide, and the tooth is subsequently subjected to heat treating. Accordingly, during the digging operation, the outer cylindrical surface 34 will wear at a greater rate respective to the hard surfaced inner conical member 32, thereby maintaining the edge 33 sharp due to the relative wear rates of the cone and cylinder surfaces.

The holder 14 is fabricated by the provision of two right hand and two left hand dies. The right hand dies, for example, are used in fabricating the main body member to which the inner cylindrical member 51 is subsequently affixed. After the inner cylindrical member and main body member have been fabricated, they are placed in the illustrated position seen in FIGS. 3, 4, 6 and 10; and, the edge portions 52, 53 are welded as illustrated at 65, 65' in FIG. 10. Thereafter, the holder is subjected to heat treating. The holder is attached to the chain of a prior art trenching machine in the same manner that various prior art digging teeth are attached, that is, by bolting the flange member 62 onto the chain by utilizing the spaced apertures 42. After the right and left hand holders have been secured in alternate positions along the endless chain of the trencher, the corresponding right and left hand digging teeth are installed within the tooth receiving cavity 66. This is accomplished by telescopingly inserting the shank of a tooth within the holder cavity, and then placing a drift pin within the illustrated receptacle 76 therefor, and striking the drift pin with sufficient force to drive the shank further into the C.W. HEMPHILL holder cavity, thereby wedgedly capturing the tooth shank within the cavity in a removable manner. The cavity is not noticably deformed when the tooth has been properly installed. It is preferred that approximately 1/16 of an inch clearance remain at 53 between edge 46 and shoulder 38, as seen in FIG. 3, for example.

As the tooth engages and excavates the material to form a trench, the hard surface metal at 32 wears at a slower rate as compared to the metallic cylindrical surface at 34, and accordingly, as the material is removed or worn away at 34, a continuous new cutting edge is presented at 33. This action maintains the edge of the tooth digging end in properly sharpened condition during the entire life of the tooth.

When it becomes necessary to replace a worn tooth, a drift pin is placed in the rearwardly extending receptacle 76 therefor, and again the drift pin is impacted with a suitable hammer, thereby driving the digging tooth from the holder cavity. A new tooth is replaced as in the before described manner.

When digging in rocky formations, the chain and support assembly therefor often commences to chatter, or make rapid movements in the vertical plane. This undue vibration sets up a harmonic motion which causes severe loads to be placed on the tooth and holder. This force will sometime loosen a tooth from its cavity. In this type formation, it is advantageous to provide round apertures 72 and 73 within the holder, and an oblated or oblong aperture 74 within the tooth shank so that a rolled pin 76' can be forced therein, thereby loosely capturing the tooth shank respective to the cavity of the holder. The rolled pin prevents the tooth from falling from the cavity and does not hold the tooth in place during normal digging. The tooth will tighten itself back into proper seated position when a more suitable formation is subsequently encountered; however, the rolled pin will prevent occasional loss of a tooth under the above adverse conditions.

The digging tooth and holder assembly of the present invention can advantageously be used on a digging bucket, for example, a digging bucket such as illustrated in FIG. 2. In this instance, the web 62 is eliminated and the rear marginal end of the tooth holder is made into the illustrated dovetail configuration so that the bucket lip can be welded therewithin.

Figure 17:
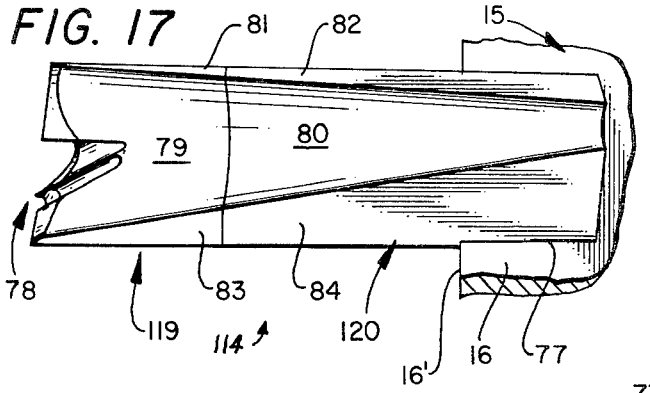
FIG. 17 is a perspective side view illustrating part of the apparatus disclosed in FIG. 2.

In FIG. 17 there is illustrated a digging tooth and holder assembly 114 for attachment to the digging bucket 15 such as illustrated in FIGS. 2 and 25–28. The digging tooth and holder assembly 114 comprises a digging tooth 119 removably received within a cavity formed within holder member 120, in a manner similar to the foregoing digging tooth and holder assembly 14. The rear marginal portion of the holder is provided with a lateral slot 77 which receives the lip 16 of a digging bucket 15 therewithin. The forward ground engaging end 78 of the tooth is made into a configuration which enables the digging tooth and holder assembly to be used in any number of different positions at the leading end of a hydraulic excavating bucket, so that only one type of tooth need be employed along the entire leading edge of the bucket, as will be better appreciated later on as the remainder of this disclosure is more fully digested.

As seen in FIGS. 17–24, the tooth includes a leading ground engaging end 78 which uniformly slopes from a sharp cutting edge into a curved upper surface 79. The upper curved surface 79 uniformly continues at curved upper surface 80 of the holder. The cross-sectional area of the holder more or less is square in configuration. The assembled holder and tooth jointly present adjacent upper sides 81, 82 and adjacent upper sides 83, 84.

Figure 18:
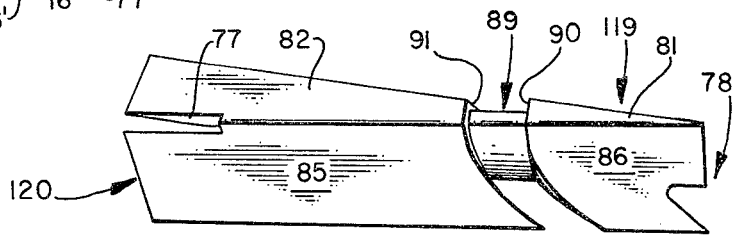
FIG. 18 is a partially disassembled view of the apparatus disclosed in FIG. 17.
Figure 19:
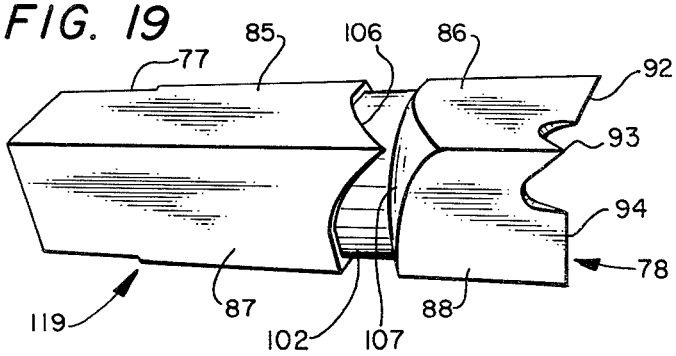
FIG. 19 is a bottom view of the apparatus disclosed in FIG. 18.

As seen in FIG. 18, together with other figures of the drawings, lower adjacent surfaces 85, 86, respectively, of the holder and tooth, respectively, are adjacent to the respective adjacent sides 82, 81. The cutting head of the tooth rearwardly reduces in size to form a curved shank 89, which forms an integral part of the digging tooth, with the shank having a forward end joined to the trailing end of the cutting head, and with a shoulder 90 being formed about the periphery found between the shank and the rear part of the head.

The holder forwardly terminates in a shoulder 91 which defines the entrance into the outwardly opening cavity thereof.

Figure 20:
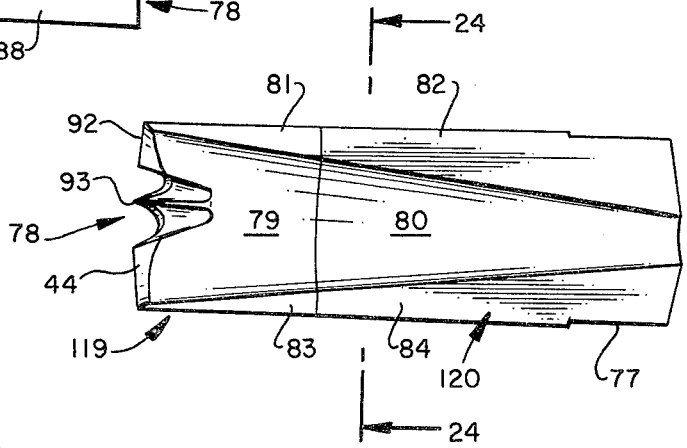
FIG. 20 is a top plan view of the apparatus disclosed in FIG. 19.
Figure 21:
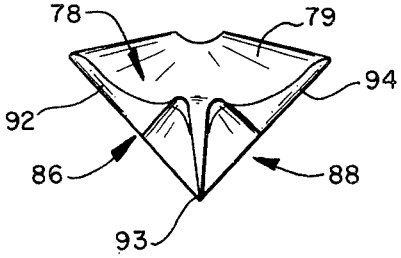
FIG. 21 is a front view of the apparatus disclosed in FIG. 20.

As best seen in FIGS. 20 and 21, the tooth includes a forward cutting edge which terminates in a substantially vertical plane, with there being a right hand cutting blade 92, a left hand cutting blade 94, and a central cutting blade 93; with the cutting blades 92, 94, having cutting edges thereon arranged perpendicularly respective to one another, and with the central ground engaging member 93 forming the central portion of the right angle blade.

Figure 22:
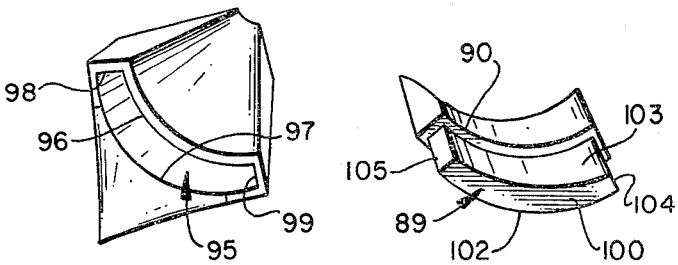
FIG. 22 is a disassembled end view of the tooth and holder assembly seen illustrated in FIGS. 17–21.
Figure 23:
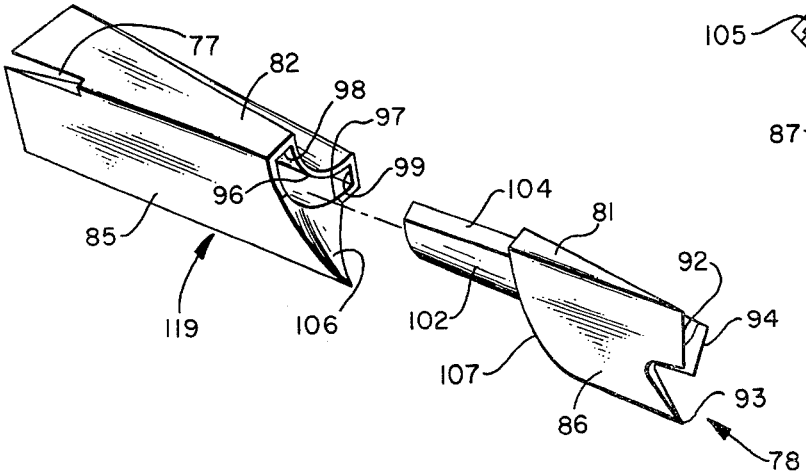
FIG. 23 is a perspective disassembled view of a tooth and holder assembly made in accordance with the present invention.
Figure 24:
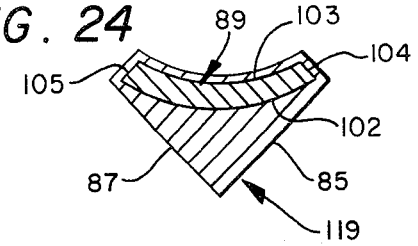
FIG. 24 is a cross-sectional view taken along line 24—24 of FIG. 20.

In FIGS. 22 and 23, the cavity 95 of the holder is circular or curved in configuration, and includes an upper curved wall 96, a lower curved wall 97, with the upper and lower curved walls terminating at end walls 98 and 99.

The shank 89 includes a lower wall surface 102, an upper wall surface 103, and opposed end walls 104, 105. The shank is therefore made into a curved configuration which is complementary respective to the cavity 95.

As seen in FIG. 23, a forward projection 106 located on the holder is made into a configuration to receive a complementary, recessed face 107 formed on the rear of the tooth head, with the face 107 seating against the surface formed by the projection 106.

Figure 25:
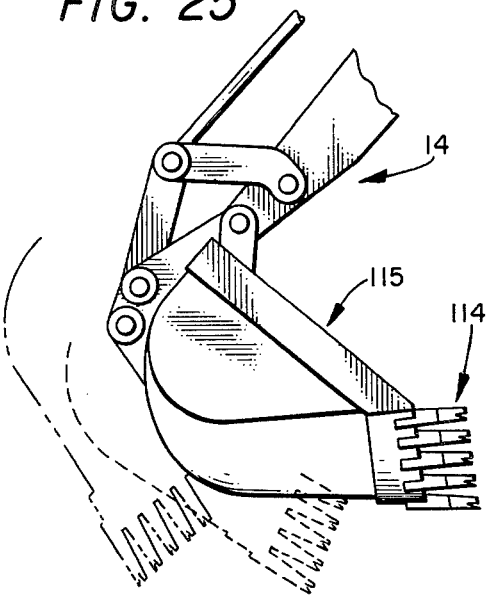
FIG. 25 illustrates another excavating bucket having a tooth and holder assembly made in accordance with the present invention.
Figure 26:
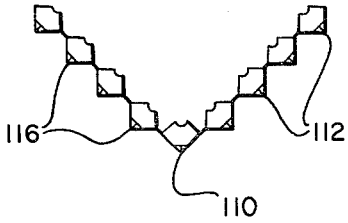
FIG. 26 is a front end view of the bucket disclosed in FIG. 25.
Figure 27:
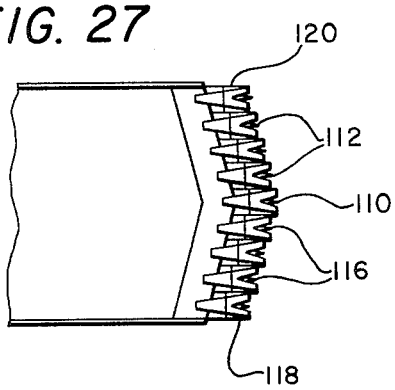
FIG. 27 is a broken, top plan view of the bucket seen illusttrated in FIG. 24; and, FIG. 28 is a front diagrammatical view of a flat bottom bucket having a tooth and holder assembly such as illustrated in the foregoing figures.

In FIGS. 25 and 27, a hydraulic excavator 14 has a V-bottom digging bucket 115 operatively affixed to the dipper stick thereof. Digging teeth are attached thereto, by any suitable means, as for example, the before mentioned holder having a slot 77 which receives the bucket lip therewithin. As seen in FIG. 27, the forward digging end of the bucket includes a forwardmost digging tooth and holder 114 at position 110. In this configuration, the tooth is aligned respective to the bucket as seen illustrated in FIG. 26, wherein the sides 85 and 86 of the tooth and holder are disposed vertically and horizontally. The teeth may instead be oriented with the sides arranged at 45° respective to the horizontal. The outermost teeth 120, however, are preferably arranged with one side 86 being inwardly directed and parallel to the horizontal, while another side 88, for example, is arranged vertically respective to the horizontal, that is, oriented in the illustrated manner of FIG. 26. The opposed tooth 118 is similarly arranged respective to the bucket.

Figure 28:
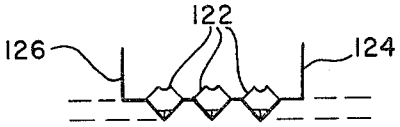

In the flat bottom bucket diagrammatically illustrated in FIG. 28, the central teeth are arranged with the lower adjacent sidewalls thereof placed at 45° respective to the horizontal, while the outermost teeth at 124 and 126 are each arranged with one wall surface 88, for example, perpendicular to the horizontal, and the adjacent wall surface 86 being disposed horizontally, which is the same orientation set forth in FIG. 26.

The teeth set forth in the embodiment of FIGS. 17–28 are assembled and removed from the tooth receiving cavity in the same described manner of the other embodiments of this invention.

I claim:

1. In a digging apparatus of the type having a digging tooth removably received within a tooth receiving holder, wherein the holder is affixed to the digging apparatus and includes a socket formed therewithin within which a shank of the tooth is removably received, the improvement comprising:

said socket of said holder outwardly opens and rearwardly tapers to that the socket is progressively reduced in size; said socket is formed by spaced curved interior wall surfaces joined together at spaced locations along the circumference of the spaced wall surfaces to form an arc, the interior peripheral wall surface of the socket is continuous when viewed in lateral cross-section;

said tooth includes a cutting head at one end thereof, said tooth shank rearwardly extends from said cutting head and is rearwardly tapered complementary respective to said socket;

said shank is of annular configuration when viewed in lateral cross-section; said shank of said tooth is telescopingly received within said socket of said holder where said shank is wedgedly held in assembled relationship therewith.

2. The improvement of claim 1 wherein the annular configuration of said shank when viewed in lateral cross-section, circumferentially extends about one-half of a circle.

3. The improvement of claim 1 wherein said cutting head includes a cylindrical outer wall surface, a conical inner wall surface, with a curved cutting edge being formed therebetween.

4. The improvement of claim 3 wherein said conical inner surface is made relatively hard respective to said cylindrical outer surface, thereby causing the outer cylindrical surface to wear away at a greater rate respective to the conical inner surface, whereupon said curved cutting edge remains in a sharpened condition during usage thereof.

5. The improvement of claim 4 wherein said digging apparatus is a bucket having a forward ground engaging end to which said holder is affixed.

6. The improvement of claim 1 wherein said digging apparatus is a chain type trencher and said holder includes mount means by which said holder is affixed to the endless chain of the trencher.

7. In a digging apparatus having a digging tooth, a shank made integral with and extending rearwardly from a digging head of the tooth, a shank receiving holder affixed to structure associated with the digging apparatus, a shank receiving cavity formed within said holder by which the tooth is removably mounted to the holder; the combination of said digging tooth and holder, comprising:

said shank is curved in lateral cross-section and forms an annulus; said shank is inwardly tapered longitudinally in a direction towards the digging head thereof;

the socket of said holder outwardly opens towards the digging end of the tooth, and is made in annular configuration complementary respective to the tapered shank; whereby, said shank is wedgedly received in a removable manner within the socket of said holder;

said socket is formed by spaced interior curved wall surfaces joined at a location which defines the magnitude of the arc of the wall surfaces.

8. The combination of claim 7 wherein said annulus circumferentially extends more that 90° and less than 270° of curvature.

9. The combination of claim 7 where the annular configuration of the socket is about one-half of a circle in cross-section.

10. The combination of claim 7 wherein said digging head includes an outer cylindrical surface, and inner conical surface, with a curved cutting edge being formed therebetween.

11. The combination of claim 7 wherein said conical inner surface is made relatively hard respective to said cylindrical outer surface, thereby causing the outer cylindrical surface to wear away at a greater rate respective to the conical inner surface, whereupon said curved cutting edge remains in a sharpened condition during usage thereof.

12. In a digging tooth and holder therefor, wherein the holder is attachable to a digging apparatus, with the tooth having a digging end opposed to a shank which extends rearwardly therefrom, and the holder has a socket formed therein for removable receiving the shank therewithin so that the tooth can be removed from the holder; the improvement comprising:

the holder socket is formed by spaced curved sidewalls which extend along a curved path for less than 270° and more that 90° of curvature, said sidewalls terminate at a shank receiving entrance, said sidewalls converge towards one another in a direction away from the entrance of the socket; said socket describes a segment of an annular configuration;

said shank is made complementary respective to the socket and is wedgedly received therewithin;

the interior wall surface of said socket is uninterrupted when viewed in lateral cross-section.

13. The improvement of claim 12 wherein the annular configuration of said holder and shank, when viewed in lateral cross-section, circumferentally curves about one-half of a circle.

14. The improvement of claim 12 wherein the annular configuration of said holder socket circumferentially extends about a point an amount equal to one-half of a circle, said curved sidewalls terminate at spaced longitudinal edges which converge rearwardly toward one another.

15. The improvement of claim 12 wherein said digging end includes a cylindrical outer wall survace, a conical inner wall surface, with there being a curved cutting edge formed therebetween.

16. The improvement of claim 15 wherein said conical inner surface is made relatively hard respective to said cylindrical outer surface, thereby causing the outer cylindrical surface to wear away at a greater rate respective to the conical inner surface, whereupon, said curved cutting edge remains in a sharpened condition with usage thereof.

17. The improvement of claim 16 wherein said digging apparatus is a bucket having a leading ground engaging end to which said holder is affixed.

18. A digging tooth and holder assembly for attachment to an excavating apparatus; said tooth includes a digging end and a shank attached thereto and depending therefrom by which the tooth is removable mounted within the holder;

an elongated, outwardly opening socket extending into said holder, said socket is a frustum of a conical annulus which is curved about an axis spaced therefrom, and has spaced interior wall surfaces which converge towards one another to provide a wedge-like curved cavity:

said interior wall surfaces, when viewed in lateral cross-section, is continuous to form an uninterrupted enclosure;

said shank is made complementary to said socket and is wedgedly received in a removable manner therewithin;

and means by which said holder can be attached to an excavating apparatus.

19. The apparatus defined in claim 18 wherein the annulus circumferentailly curves more that 60° and less the 270° when viewed in lateral cross-section.

20. The apparatus defined in claim 18 wherein the annlar configuration circumferentially extends about one-half of a circle.

21. The apparatus defined in claim 18 wherein said digging end includes a cylindrical outer wall surface, a conical inner wall surface, with a curved cutting edge being formed therebetween.

22. The apparatus defined in claim 21 wherein said conical inner surface is made relatively hard respective to said cylindrical outer surface, thereby causing the outer cylindrical surface to wear away at a greater rate respective to the conical inner surface, whereupon said curved cutting edge remains in a sharpened condition with usage thereof.

* * * * *

UNITED STATES PATENT AND TRADEMARK OFFICE

CERTIFICATE OF CORRECTION

PATENT NO. : 4,476,642

DATED : OCTOBER 16, 1984

INVENTOR(S) : CHARLES W. HEMPHILL

It is certified that error appears in the above—identified patent and that said Letters Patent is hereby corrected as shown below:

Column 2, line 55, delete "C W. HEMPHILL";

Column 7, line 10, delete "C. W. HEMPHILL";

Column 9, line 65, "cavity" should read --socket--;

Column 10, line 21, substitute --an-- for "and";

Line 40, substitute --than-- for "that";

Line 61, substitute --surface -- for "survace";

Column 11, line 9, substitute --removably-- for "removable";

Column 12, line 10, substitute --annulus-- for "annlar configuration".

Signed and Sealed this

*Twenty-fifth* Day of *June 1985*

[SEAL]

*Attest:*

DONALD J. QUIGG

*Attesting Officer* *Acting Commissioner of Patents and Trademarks*